US005662490A

United States Patent [19]

Ogawa

[11] Patent Number: 5,662,490

[45] Date of Patent: Sep. 2, 1997

[54] BULB SOCKET AND METHOD FOR USING

[75] Inventor: Shinji Ogawa, Yokkaichi, Japan

[73] Assignee: Sumitomo Wiring Systems, Ltd., Yokkaichi, Japan

[21] Appl. No.: 554,539

[22] Filed: Nov. 6, 1995

[30] Foreign Application Priority Data

Nov. 18, 1994 [JP] Japan ..... 6-309697

[51] Int. Cl.[6] ..... H01R 4/50

[52] U.S. Cl. ..... 439/336

[58] Field of Search ..... 439/335, 336, 439/356, 611, 613, 617, 618, 619, 862, 672, 673, 674

[56] References Cited

U.S. PATENT DOCUMENTS 5,320,553 6/1994 Ogawa ..... 439/336

FOREIGN PATENT DOCUMENTS 3-131089 12/1991 Japan .

*Primary Examiner*—P. Austin Bradley
*Assistant Examiner*—Yong Kim
*Attorney, Agent, or Firm*—Oliff & Berridge

[57] ABSTRACT

An object of the invention is to provide a light bulb socket that prevents the erroneous insertion of a light bulb. A light bulb socket has contactor inserting slits 15 and 16 with their inlets 15*a* and 16*a* at the edge of the opening of a bulb engaging section 12, and bulb inserting grooves 31. The inlets 31*a* of bulb inserting grooves 31 have smaller heights than the inlets 15*a* and 16*a* of the contactor inserting slits 15 and 16. The edge of the opening of the bulb inserting section slopes from each of the inlets 15*a* and 16*a* down to the inlets 31*a*, thus providing guide surfaces 36. The light bulb is connected to the bulb socket by turning it clockwise and counterclockwise with its base inserted into the bulb engaging section 12. Even if, in this operation, locking pins 6 protruded from the bulb base are located near the inlets 15*a* and 16*a* of the contactor inserting slits 15 and 16, they are not focused into the inlets 15*a* and 16*a*, and instead are slid down the guide surfaces 36, because the edge of the opening of the bulb engaging section 12 slopes from each of the inlets 15*a* and 16*a* down to the inlets 31*a*. When, under this condition, the light bulb 1 is pushed into the bulb socket S, the pins 6 are led along the guide surfaces 36 to the inlets 31*a* of the bulb inserting grooves 31.

19 Claims, 4 Drawing Sheets

BULB SOCKET AND METHOD FOR USING

BACKGROUND OF THE INVENTION

1. Field of the Invention

This invention relates to a bulb socket that is able to prevent the erroneous insertion of a light bulb.

2. Description of Related Art

An example of a light bulb socket has been disclosed by Japanese Unexamined Patent Application No. 131089/1991. The light bulb socket is formed with a socket body of synthetic resin. One end portion of the socket body is formed into a connector section to which a mating connector is connected and the other end portion has a bulb engaging hole with which a light bulb is engaged. In order to fixedly insert contactors in the bulb engaging hole, a pair of contactor inserting grooves is formed in the inner cylindrical surface of the bulb engaging hole so that the grooves are axially extended and diametrically opposed to each other. In addition, a pair of bulb inserting grooves is formed in the inner cylindrical surface of the bulb engaging hole in such a manner that the bulb inserting grooves are angularly shifted from the contactor inserting grooves and diametrically opposed to each other. The bulb inserting grooves are so-called "J-slots" that receive locking pins extending from the bulb base. Each of the bulb inserting grooves includes a guide portion that is axially extended and a locking portion that is extended laterally from the deep end of the guide portion.

The light bulb is connected to the socket in the following manner. First, the contactors are fixedly inserted into the bulb engaging hole through the contactor inserting grooves. Next, the bulb base is inserted into the bulb engaging hole with its locking pins set at the inlets of the bulb inserting grooves. When in this position, the light bulb is turned slightly until the locking pins are engaged with the locking portions of the bulb inserting grooves. Thus, the bulb is prevented from coming off the socket, while the bulb base is engaged with the contactors. The light bulb is thereby fixedly and electrically connected to the bulb socket.

The above-described conventional light bulb socket suffers from several difficulties. In inserting the bulb base into the bulb engaging hole, frequently the locking pins of the base are erroneously inserted into the contactor inserting grooves. In this instance, the light bulb is not correctly connected to the socket and the electrical connection of the bulb base to the contactors is unsatisfactory. Since the locking pins are not locked, the bulb may drop from the socket when vibrated or otherwise disturbed.

SUMMARY OF THE INVENTION

An object of the invention is to eliminate the above-described difficulties accompanying a conventional light bulb socket. More specifically, an object of the invention is to provide a light bulb socket that is able to prevent the erroneous insertion of a light bulb.

The foregoing object of the invention has been achieved by the provision of a light bulb socket in which a socket body has a bulb engaging hole in one end portion thereof with which the base of a light bulb is engaged. The socket body also includes contactor inserting slits for inserting contactors into the bulb engaging hole and bulb inserting grooves for fixedly inserting pins that are embedded in the base of the light bulb. The slits and grooves are formed in an inner cylindrical surface of the bulb engaging hole and are angularly spaced from one another. The edge of the opening of the bulb inserting hole is so shaped that relatively small parts of the edge that define the inlets of the contactor inserting slits have a greater height or are at greater distances from the base of the bulb engaging hole than the remaining part of the edge.

In an embodiment of the present invention, the edge of the opening of the bulb inserting hole is so shaped as to provide a pair of guide surfaces on both sides of the inlet of each bulb inserting groove. The guide surfaces slope down to the inlets of the bulb inserting grooves to guide the pins to the inlets of the bulb inserting grooves.

While a light bulb is being connected to a light bulb socket, the locking pins of the bulb base are seldom positioned at the inlets of the bulb inserting grooves. In many cases the locking pins are located near at the contactor inlets. Therefore, the light bulb is turned clockwise and counterclockwise to locate the inlets of the bulb inserting grooves. In this operation, the locking pins may be inserted into the contactor inserting grooves.

This difficulty is eliminated by the provision of the light bulb socket of the invention. In the light bulb socket of the present invention, the edge of the opening of the bulb engaging hole is so shaped that relatively small parts of the edge that define the inlets of the contactor inserting slits have a greater height than the remaining part of the edge. Hence, while the light bulb is being turned to locate the inlets of the bulb inserting grooves, the locking pins are slid from the inlets of the contactor inserting grooves down to the inlets of the bulb inserting grooves. Thus, the locking pins are prevented from being inserted into the contactor inserting grooves.

With the light bulb socket as described above, the locking pins of the bulb base are automatically led along the guide surfaces to the inlets of the bulb inserting grooves when slid down from the inlets of the contactor inserting grooves or moved from the bulb inserting grooves. Therefore, the light bulb socket is effective in decreasing the possibility that the light bulb will be erroneously inserted into the bulb socket.

Additionally, in an embodiment of the present invention, the locking pins of the bulb base are automatically led to the inlets of the bulb inserting grooves. Hence, the bulb socket has not only the above-described effect but also an effect that the light bulb can be readily and efficiently connected to the bulb socket.

Other objects, advantages, and salient features of the invention will become apparent from the detailed description taken in conjunction with the annexed drawings, which disclose preferred embodiments of the invention.

BRIEF DESCRIPTION OF THE DRAWINGS

A complete understanding of the present invention may be obtained by reference to the accompanying drawings, when considered in conjunction with the subsequent detailed description thereof, in which.

DETAILED DESCRIPTION OF PREFERRED EMBODIMENTS

The invention will be described with reference to its preferred embodiments shown in the accompanying drawings.

Figure 1:
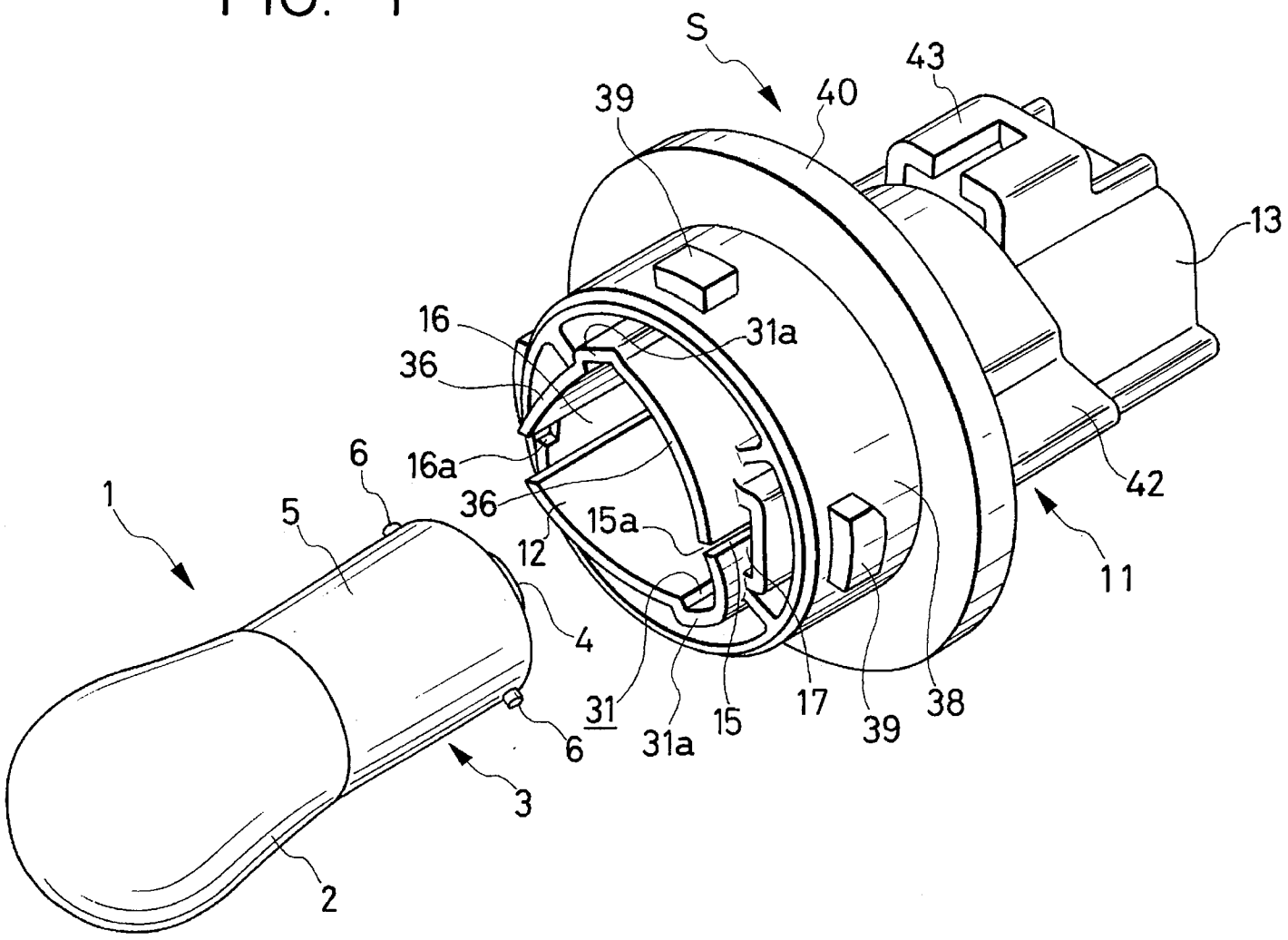
FIG. 1 is a perspective view showing an example of a light bulb socket that constitutes a first embodiment of the invention, and a light bulb to be connected to the socket.

A first embodiment of the invention is shown in FIGS. 1 through 5. In FIG. 1, light bulb 1 is of conventional structure. The light bulb 1 includes a glass bulb 2 having a filament, a base 3 connected to the glass bulb 2, and an anode 4 formed on the end face of the base 3. The base 3 includes a cylindrical wall that serves as a cathode 5. The cylindrical wall of the base 3 has a pair of locking pins 6 at angular intervals of approximately 180° that are used to fixedly insert the light bulb into a light bulb socket S according to the invention.

The bulb socket S has a socket body 11 of synthetic resin. The socket body 11 has one end portion, which is formed into a bulb engaging section 12 in the form of a cylinder circular in section, and another end portion, which is formed into a male connector section 13 in the form of a cylinder rectangular in section to which a female connector (not shown) is connected.

The bulb engaging section 12 has a cylindrical wall with two contactor inserting slits 15 and 16 that are utilized to insert a contactor 19 (hereinafter referred to as "a positive contactor 19") for the anode and a contactor 26 (hereinafter referred to as "a negative contactor 26") for the cathode into the bulb engaging section 12 (cf. FIGS. 4 and 5). More specifically, the contactor inserting slits 15 and 16 are diametrically opposed to each other, and extend along the axis of the bulb engaging section 12 with their inlets 15*a* and 16*a* at the edge 50 of the opening of the bulb engaging section 12. Slits 15 and 16 have different widths. The narrower slit 15 is provided for the positive contactor and the wider slit 16 is provided for the negative contactor. Guide paths 17 are formed outside each of the contactor inserting slits 15 and 16, in such a manner that each slit communicates with a guide path.

Figure 4:
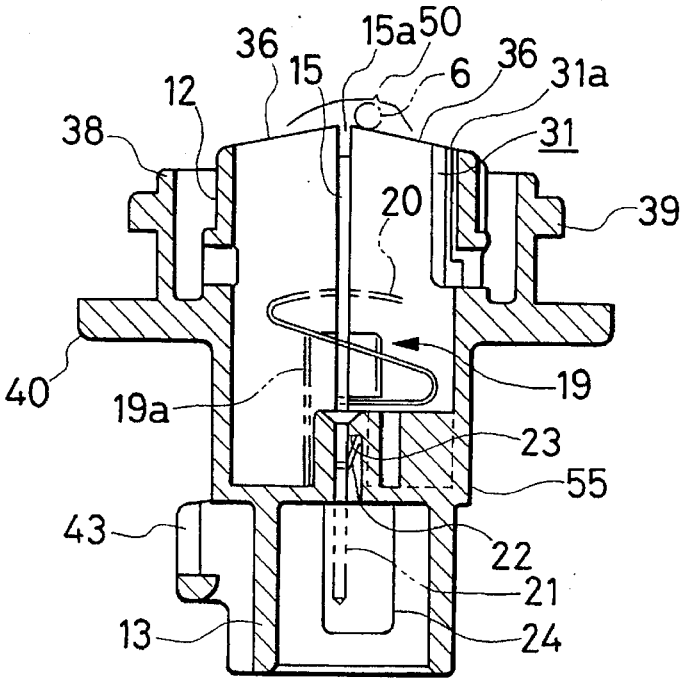
FIG. 4 is a sectional view taken along line X—X in FIG. 2.

The positive contactor 19, as shown in FIG. 4, includes an inserting portion 19*a* that is inserted into the contactor inserting slit 15 and the guide path 17 on the anode side, an S-shaped contacting portion 20 that is elastically brought into contact with the anode 4 of the base 3, and a tab portion 21. As described above, the inserting portion 19*a* of the positive contactor 19 is inserted into the contact inserting slit 15 and the guide path 17 on the anode side. When, in this operation, a locking piece 22 protruded from the contactor 19 is engaged with a locking hole 23 formed in the socket body 11, the contactor 19 is fixedly locked to the socket body 11. Additionally, the contacting portion 20 of the contactor 19 is set deep in the bulb engaging section 12 while the tab portion 21 penetrates the bottom of the bulb engaging section 12, thus being extended over one side of a partition wall 24 formed in the male connector section 13.

Figure 5:
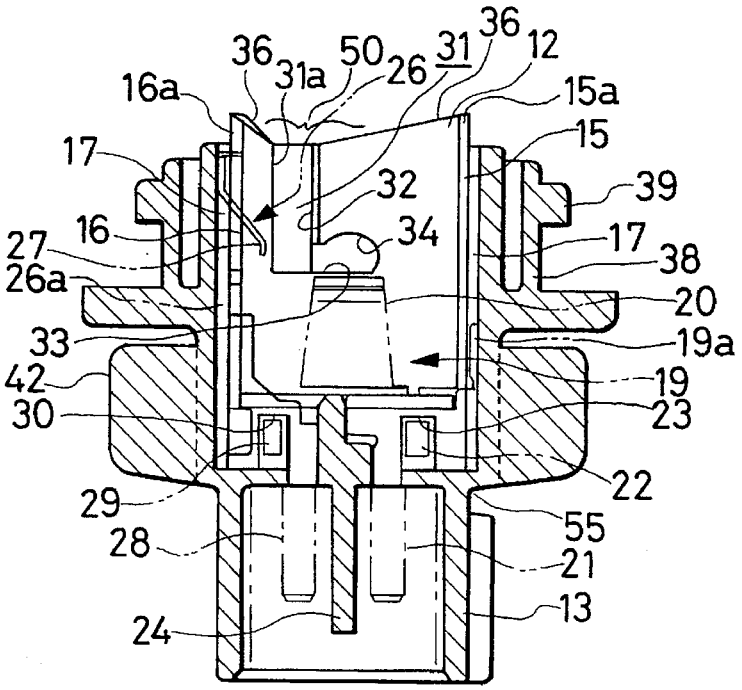
FIG. 5 is also a sectional view taken along line Y—Y in FIG. 2.
Figure 6:
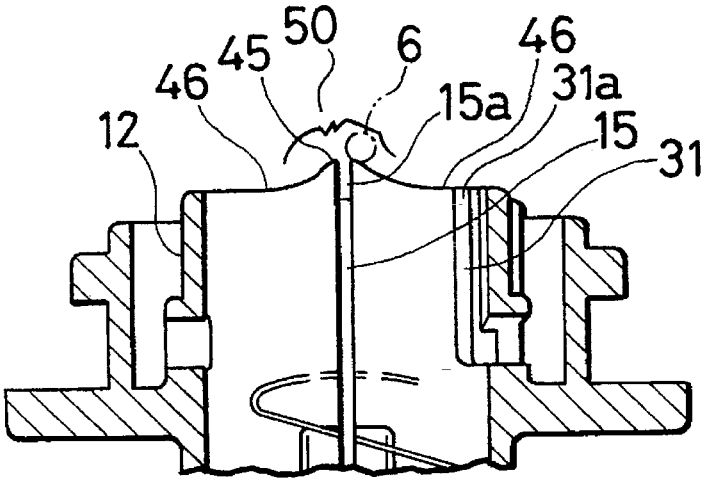
FIG. 6 is a fragmentary sectional view showing a second embodiment of the invention.

The negative contactor 26, as shown in FIG. 5, includes an inserting portion 26*a* that is inserted into the contactor inserting slit 16 and the guide path 17 on the cathode side. A tongue-shaped contacting portion 27 is elastically brought into contact with the cylindrical wall of the bulb base 3, i.e., the cathode 5, and a tab portion 28. When the negative contactor 26 is inserted into the socket body along the contactor inserting slit 16 and the guide 17, a locking piece 29 protruding from the contactor 26 is engaged with a locking hole 30 formed in the socket body 11. Thereby, the contactor 26 is fixedly locked to the socket body 11, while the contacting portion 27 is radially inwardly protruded into the bulb engaging section 12 through the contactor inserting slit 16, and the tab portion 28 is extended over the other side of the partition wall 24 in the male connector section 13.

Figure 2:
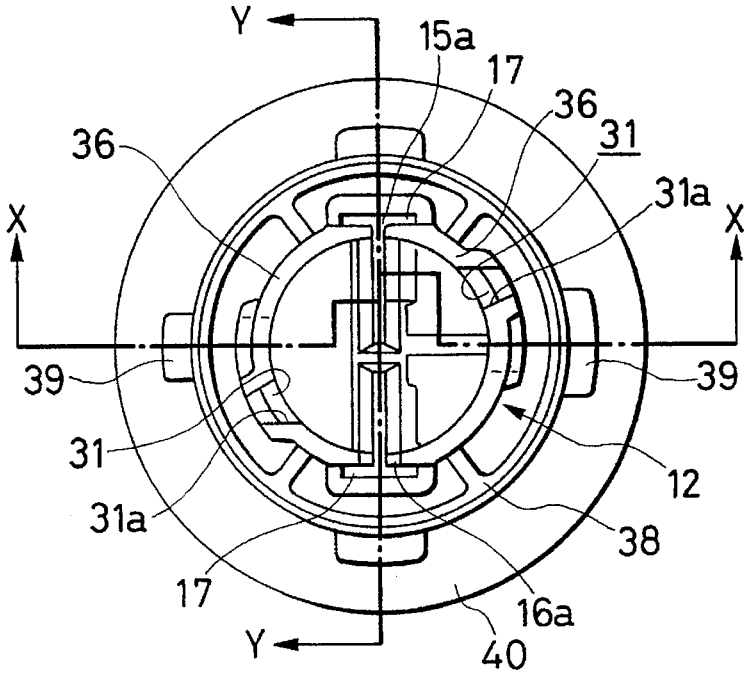
FIG. 2 is a front view of the light bulb socket shown in FIG. 1.
Figure 3:
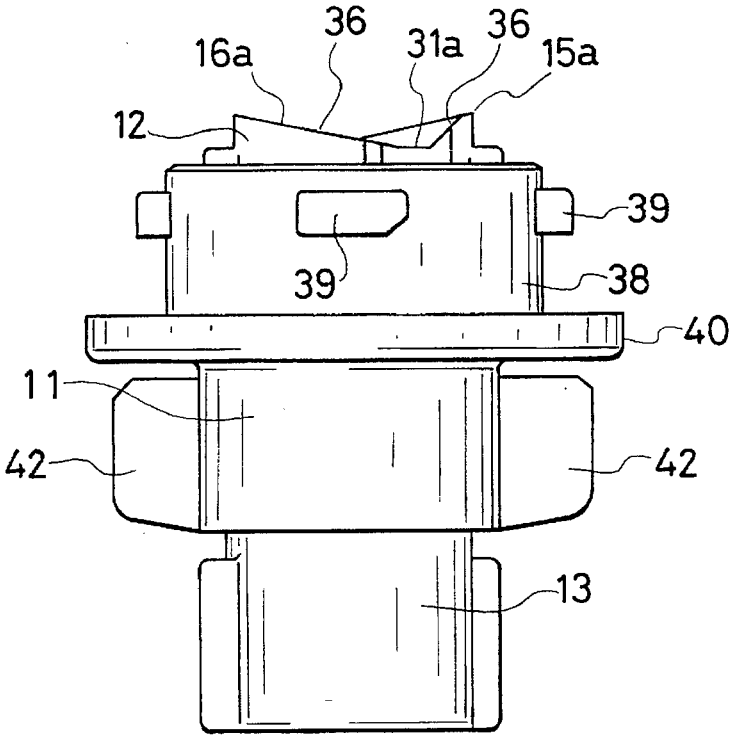
FIG. 3 is a side view of the light bulb socket shown in FIG. 1.

A pair of bulb inserting grooves 31 is formed in the inner cylindrical surface of the bulb engaging section 12 in such a manner that the grooves are shifted clockwise from the contactor inserting slits 15 and 16, respectively, as viewed in FIG. 2, and are diametrically opposed to each other. The grooves 31 are "J-slots" into which the locking pins 6 protruded from the bulb base 3 are fixedly inserted. Each of the bulb inserting grooves 31 includes a guide portion 32, which is extended axially with its inlet 31*a* at the edge of the opening of the bulb engaging section 12, and a locking portion 33, which is extended clockwise from the lower end of the guide portion 32 in the cylindrical surface as viewed in FIG. 2. The guide portion 32 is a bottomed groove, while the locking portion 33 is in the form of a through-hole. The locking portion 33 has a cut 34 at the deep end that is formed towards the opening of the bulb engaging section 12. The cuts 34 of the bulb inserting grooves 31 positively hold the locking pins 6 of the light bulb, thereby preventing the locking pins 6 from returning to the guide portions 32.

The positional relationships between the inlets 15*a* and 16*a* of the contactor inserting slits 15 and 16 are defined by the edge 50 of the opening of the bulb engaging section 12 and the inlets 31*a* of the bulb inserting grooves 31 as shown in FIGS. 4 and 5. As viewed in FIGS. 4 and 5, the inlets 31*a* of the bulb inserting grooves 31 are located a certain distance below, or closer to a base 55 of the bulb engaging hole, than the inlets 15*a* and 16*a* of the contactor inserting slits 15 and 16. The inlets 31*a* are equal in height to each other (or equidistant from the base 50), and the inlets 15*a* and 16*a* are also equal in height (or equidistant from the base 55) to each other.

The edge 50 of the opening of the bulb engaging section 12 slopes from the inlet 15*a* of the contactor inserting slit 15 down to the inlet 31*a* of the bulb inserting groove 31 located on both sides of the bulb engaging section. Similarly, the opening of the bulb engaging section 12 slopes from the inlet 16*a* to the inlet 31*a*. The slopes provide guide surfaces 36 that lead the locking pins 6 of the bulb base 3 to the inlets 31*a* of the bulb inserting grooves 31.

A mounting cylinder 38 is provided around the bulb engaging section 12. A predetermined gap exists between the mounting cylinder 38 and the bulb engaging section 12. The assembly of the mounting cylinder 38 and the bulb engaging section 12 forms a dual cylinder. Four locking protrusions 39 are formed on the outer cylindrical surface of the front end portion of the mounting cylinder 38 at angular intervals of approximately 90°, and a fixing flange 40 is formed on the outer cylindrical surface of the rear end portion of the mounting cylinder 38. A lamp panel (not shown), on which the bulb socket S is to be mounted, has a mounting hole with which the mounting cylinder 38 is to be engaged. The mounting hole has four relief cuts in correspondence to the four locking protrusions 39 formed on the mounting cylinder 38. The mounting cylinder 38 is inserted into the mounting hole with the locking protrusions 39 aligned with the relief cuts, and after the fixing flange 40 abuts against the lamp panel, the bulb socket S is turned. As a result, the locking protrusions 39 are moved over the edge portions of the mounting hole, thus fixedly pushing the edge portions of the mounting hole against the fixing flange 40. Thus, the bulb socket S has been fixedly mounted on the lamp panel. The socket body 11 has a pair of operating knobs 42 protruding from the outer cylindrical surface between the male connector section 13 and the fixing flange 40, so as to facilitate the turning of the bulb socket S. The male connector section 13 has a locking portion 43 on its outer surface that is locked to a mating female connector.

The light bulb socket of the first embodiment is constructed as described above. A method of engaging the light bulb 1 with the light bulb socket S is performed as detailed below.

First, the positive and negative contactors 19 and 26 are inserted into the bulb engaging section 12 of the bulb socket S through the respective contactor inserting slits 15 and 16. As a result, the S-shaped contacting portion 20 of the positive contactor 19 is mounted on the bottom of the bulb engaging section 12, while the tongue-shaped contacting portion 27 of the negative contactor 26 is radially inwardly protruding in the bulb engaging section 12. The tab portions 21 and 28 of the contactors 19 and 26 protrude into the male connector section 13.

While the assembly is in this condition, the base 3 of the bulb 1 is inserted into the bulb engaging section 12. When the locking pins 6 abut against the edge of the opening of the bulb engaging section 12, the light bulb is turned clockwise and counterclockwise. In this case, the locking pins 6 may be located near the inlets 15*a* and 16*a* of the contactor inserting slits 15 and 16. However, since, as was described above, the edge 36 of the opening of the bulb engaging section 12 slopes from each of the inlets 15*a* and 16*a* down to the inlets 31*a* of the bulb inserting grooves 31, the locking pins 6 are not caused to go into the inlets 15*a* and 16*a*, and instead are slid down the guide surfaces 36. When, under this condition, the light bulb 1 is pushed into the light bulb socket S, the light bulb 1 is caused to turn about the central axis. The locking pins 6 are led along the guide surfaces 36 to the inlets 31*a* of the bulb inserting grooves 31, and pushed into the guide portions 32 of the bulb inserting grooves 31.

Thus, the bulb base 3 is pushed into the bulb socket while elastically deforming the contacting portion 20 of the positive contactor 19. When the locking pins 6 abut against the lower ends of the guide portions 32 of the bulb inserting grooves 31, the light bulb 1 is turned clockwise so that the pins 6 are moved into the locking portions 33. Under this condition, the bulb 1 is released. As a result, the light bulb 1 is slightly raised by the restoring elastic force of the contacting portion 20 of the positive contactor 19, so that the locking pins 6 of the bulb base 3 are set in the cuts 34 of the locking portions 33. In this operation, the anode 4 on the bulb base 3 is elastically pushed against the contacting portion 20 of the positive contactor 19, while the cathode 5 is also elastically pushed against the contacting portion 27 of the negative contactor 26. At this point, the light bulb 1 is electrically connected to the bulb socket S.

As is apparent from the above description, the light bulb socket of the first embodiment eliminates erroneous insertion of the light bulb that would be caused if the locking pins 6 of the bulb base 3 went into the contactor inserting slits 15 and 16. Furthermore, even if the locking pins 6 are shifted from the bulb inserting grooves 31, they are automatically led to the inlets 31*a* of the grooves 31, so that the light bulb is correctly engaged with the bulb socket at all times. Thus, the light bulb can be connected to the bulb socket with high efficiency.

FIG. 2 shows another example of the light bulb socket, which constitutes a second embodiment of the invention. In the second embodiment, as in the case of the above-described first embodiment, the inlets 31*a* of the bulb inserting grooves 31 are located below the inlets 15*a* and 16*a* of the contactor inserting slits 15 and 16. The inlets 31*a* have smaller heights than the inlets 15*a* and 16*a*. However, in the second embodiment, the edge 50 of the opening of the bulb engaging section 12 is shaped so that it is curved downwardly near each of the inlets 15*a* and 16*a* to provide a pair of projected surfaces 45 on both sides of the inlet, and guide surfaces 46 that slope gradually from the projected surfaces 45 down to the inlets 31*a* of the bulb inserting grooves 31.

The bulb base 3 is inserted into the bulb engaging section 12, and then turned. Even if, in this operation, the locking pins 6 of the bulb base 3 are located near the inlets 15*a* and 16*a* of the contactor inserting slits 15 and 16, they are correctly moved. Since the projected surfaces 45 are provided on both sides of each of the inlets 15*a* and 16*a*, the locking pins 6 are caused to move towards the guide surfaces 46. This will prevent the locking pins 6 of the light bulb from going into the contactor inserting slits 15 and 16. The locking pins 6 are automatically moved along the guide surfaces 46 to the inlets 31*a* of the bulb inserting grooves 31.

Figure 7:
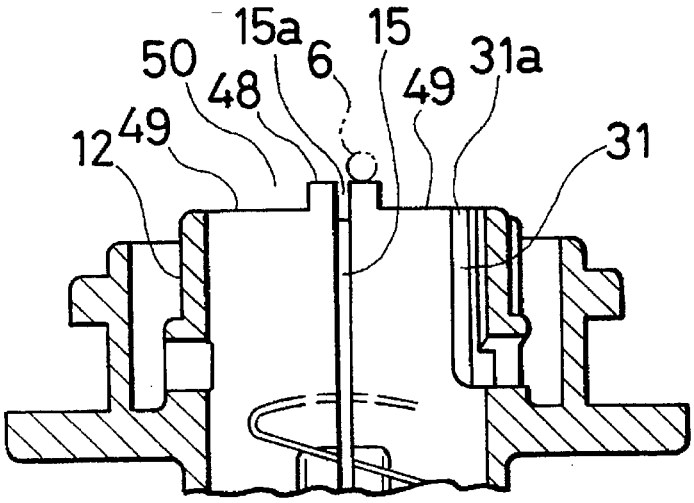
FIG. 7 is a fragmentary sectional view showing a third embodiment of the invention.

FIG. 7 shows another example of the light bulb socket, which constitutes a third embodiment of the invention. In the third embodiment, too, the inlets 31*a* of the bulb inserting grooves 31 are located below the inlets 15*a* and 16*a* of the contactor inserting slits 15 and 16. Two small portions of the edge 50 of the opening of the bulb engaging section, which are located on both sides of each of the inlets 15*a* and 16*a*, are formed into a pair of surfaces 48 having heights greater than the heights of inlets 31*a* of the bulb inserting grooves 31 (hereinafter referred to as "projected surfaces 48"). Accordingly, the remaining part of the edge is formed into flat surfaces 49 that are flush with the inlets 31*a* of the bulb inserting grooves 31.

In the third embodiment, as in the above-described embodiments, the light bulb 1 is inserted into the bulb inserting section while being turned clockwise and counterclockwise. Even if, in this operation, the locking pins 6 of the light bulb 1 are located near the inlets 15*a* and 16*a* of the contactor inserting slits 15 and 16, they are correctly moved. The locking pins 6 are caused to move from the projected surfaces 48 to the flat surfaces 49 that have smaller heights than the projected surfaces 48. The locking pins 6 are prevented from going into the contactor inserting slits 15 and 16. Thereafter, the bulb 1 is turned so that the locking pins 6 are moved along the flat surfaces 49 to the inlets 31*a* of the bulb inserting grooves 31.

In inserting the bulb 1 into the bulb engaging section 12, the locking pins 6 may abut against the flat surfaces 49 instead of the projected surfaces 48. When, in this case, the bulb 1 is turned, the locking pins 6 are struck against the steps between the surfaces 48 and 49, thus being positively prevented from going into the contactor inserting slits 15 and 16. When the locking pins 6 reach the inlets 31*a* of the bulb inserting grooves 31 while the light bulb 1 is being turned, the pins are inserted into the bulb inserting grooves 31.

While the invention has been described with reference to specific embodiments, the description is illustrative and is not to be construed as limiting the scope of the invention. Various modifications and changes may occur to those skilled in the art without departing from the spirit and scope of the invention.

What is claimed is:

1. A light bulb socket including a socket body having a bulb engaging hole in one end portion, the bulb engaging hole comprising an opening and a base opposite the opening, the light bulb socket comprising:

a socket body edge at the opening, the socket body edge having a plurality of portions more distant from the base and a plurality of points less distant from the base;

contactor inserting slits that allow insertion of contactors into said bulb engaging hole, each of said contactor inserting slits having a slit inlet portion along the socket body edge; and bulb inserting grooves formed on an inner cylindrical surface of said bulb engaging hole for fixedly inserting locking pins that protrude from a light bulb base, wherein said contactor inserting slits and said bulb inserting grooves are angularly spaced along the socket body.

2. The light bulb socket of claim 1, wherein the slit inlet portion of each of said contactor inserting slits is located at one of the portions more distant from the base.

3. The light bulb socket of claim 1, wherein each of said bulb inserting grooves has a groove inlet located at the socket body edge at one of the portions less distant from the base and the socket body edge is sloped to provide a pair of guide surfaces sloping down to each groove inlet to guide the locking pins to each groove inlet.

4. The light bulb socket of claim 3, wherein the guide surfaces extend from each slit inlet portion to the groove inlet of an adjacent bulb inserting groove.

5. The light bulb socket of claim 1, wherein each said slit inlet is located on one of two projected surfaces at a portion more distant from the base.

6. The light bulb socket of claim 5, wherein the socket body edge comprises a flat surface between each said groove inlet and each said projected surface.

7. The light bulb socket of claim 5, wherein the socket body edge comprises a sloped surface between each said groove inlet and each said projected surface.

8. A light bulb socket including a socket body having a bulb engaging hole in one end portion, the bulb engaging hole comprising an opening and a base opposite the opening, the light bulb socket comprising:

a socket body edge at the opening, the socket body edge having a plurality of portions more distant from the base and a plurality of portions less distant from the base;

slit means for allowing insertion of contactors into said housing means, said slit means having slit inlet portions along a socket body edge; and groove means formed on an inner cylindrical surface of said bulb engaging hole for fixedly inserting locking pins that protrude from the light bulb base, wherein said slit means and groove means are angularly spaced along the housing means.

9. The light bulb socket of claim 8, wherein the slit inlet portions of the slit means are located at the portions more distant from the base.

10. The light bulb socket of claim 8, wherein each said groove means has a groove inlet and the socket body edge is sloped to provide a pair of guide means sloping down to each groove inlet for guiding the locking pins to each inlet.

11. The light bulb socket of claim 10, wherein the guide means extends from each slit inlet portion to the groove inlet of an adjacent groove means.

12. The light bulb socket of claim 8, wherein each said slit inlet is located on one of two projected surfaces at the portion more distant from the base.

13. The light bulb socket of claim 12, wherein the socket body edge comprises a flat surface between each said groove inlet and each projected surface.

14. The light bulb socket of claim 13, wherein the socket body edge comprises a sloped surface between each groove inlet and each projected surface.

15. A method for inserting a light bulb into a bulb socket, the light bulb having a light bulb base from which locking pins extend, the method comprising:

inserting positive and negative contactors into a bulb engaging section of the bulb socket;

inserting the light bulb base into the bulb engaging section;

moving the locking pins from a higher point on a socket body edge to a lower point on the socket body edge; and guiding the locking pins into inlets of bulb inserting grooves.

16. The method of claim 15, wherein the socket body edge is sloped to provide a pair of sloping guide surfaces that slope down to the inlet of each bulb inserting groove, the moving step comprising moving the locking pins down the sloping guide surfaces.

17. The method of claim 15, wherein the moving step comprises moving each of the locking pins from a projected surface to a lower surface.

18. The method of claim 17, wherein the moving step comprises moving each of the locking pins along a flat surface between the inlet of each bulb inserting groove and each projected surface.

19. The method of claim 17, wherein the moving step comprises moving each of the locking pins along a sloped surface between the inlet of each bulb inserting groove and each projected surface.

* * * * *